US009728052B2

(12) United States Patent
Huh et al.

(10) Patent No.: US 9,728,052 B2
(45) Date of Patent: Aug. 8, 2017

(54) DIGITAL SIGNAGE SYSTEM AND EMERGENCY ALERTING METHOD USING SAME

(71) Applicant: ELECTRONICS AND TELECOMMUNICATIONS RESEARCH INSTITUTE, Daejeon (KR)

(72) Inventors: Mi-Young Huh, Daejeon (KR); Wook Hyun, Daejeon (KR); Sung-Hei Kim, Daejeon (KR); Shin-Gak Kang, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 345 days.

(21) Appl. No.: 14/257,350

(22) Filed: Apr. 21, 2014

(65) Prior Publication Data

US 2014/0313014 A1 Oct. 23, 2014

(30) Foreign Application Priority Data

Apr. 22, 2013 (KR) ..... 10-2013-0044404
Apr. 2, 2014 (KR) ..... 10-2014-0039452

(51) Int. Cl.
*G08B 5/22* (2006.01)
*G08B 7/06* (2006.01)

(52) U.S. Cl.
CPC ..... *G08B 7/066* (2013.01)

(58) Field of Classification Search
None
See application file for complete search history.

(56) References Cited

U.S. PATENT DOCUMENTS 4,556,873 A * 12/1985 Yamada ..... G08B 17/10 250/574
6,018,577 A * 1/2000 Roach, Jr. ..... H04M 3/533 379/142.01

(Continued)

FOREIGN PATENT DOCUMENTS

JP 3184543 U * 7/2013
JP 2013214304 A * 10/2013

(Continued)

*Primary Examiner* — Quan-Zhen Wang
*Assistant Examiner* — Chico A Foxx
(74) *Attorney, Agent, or Firm* — Staas & Halsey LLP

(57) ABSTRACT

A digital signage system and a method of providing information using the digital signage system are disclosed. The digital signage terminal includes an emergency detection unit, an emergency detection message generation unit, a communication unit, and an emergency alert message processing unit. The emergency detection unit collects the surrounding emergency-related information of the digital signage terminal. The emergency detection message generation unit generates an emergency detection message including the collected emergency-related information. The communication unit transmits the generated emergency detection message to a digital signage server, and receives an emergency alert message including an emergency alert corresponding to an emergency situation from the digital signage server. The emergency alert message processing unit parses the emergency alert message, and provides the emergency alert included in the emergency alert message to a user.

14 Claims, 11 Drawing Sheets

(56) References Cited

U.S. PATENT DOCUMENTS 6,499,421 B1 * 12/2002 Honigsbaum ..... G09F 19/22 116/205
7,619,538 B1 * 11/2009 Zarian ..... G08B 7/066 340/326
7,671,732 B1 3/2010 Sennett et al.
8,489,060 B2 * 7/2013 Sennett ..... H04M 11/04 340/438
8,688,071 B1 * 4/2014 Daly ..... H04B 1/38 455/404.2
8,717,164 B2 * 5/2014 Williams ..... G06Q 50/06 340/539.11
8,742,694 B2 * 6/2014 Bora ..... H05B 33/0863 315/113
9,080,883 B2 * 7/2015 Frey ..... G08B 7/066
9,221,385 B2 * 12/2015 Ford ..... B60Q 1/00
2003/0038726 A1 2/2003 Yoshida et al.
2003/0065472 A1 * 4/2003 Eckel ..... H05B 37/02 702/130
2007/0041514 A1 * 2/2007 Rodkey ..... H04L 12/1895 379/37
2007/0216535 A1 * 9/2007 Carrino ..... G06F 17/3087 340/573.1
2008/0101697 A1 * 5/2008 Cho ..... G06T 5/009 382/169
2008/0111699 A1 * 5/2008 Kwon ..... G08B 27/008 340/601
2009/0309742 A1 * 12/2009 Alexander ..... G08B 21/10 340/601
2010/0138858 A1 * 6/2010 Velazquez ..... G08B 27/006 725/33
2010/0245083 A1 * 9/2010 Lewis ..... G08B 7/066 340/540
2011/0071888 A1 3/2011 Choi et al.
2011/0095862 A1 4/2011 Yang et al.
2011/0304476 A1 * 12/2011 Johnson ..... G08G 1/081 340/906
2012/0146813 A1 * 6/2012 Gilmore ..... G08B 7/066 340/907
2013/0091213 A1 * 4/2013 Diab ..... G06Q 50/01 709/204
2014/0085107 A1 * 3/2014 Gutierrez ..... G08G 1/096766 340/905
2014/0089143 A1 * 3/2014 Dione ..... G06Q 30/02 705/26.61
2014/0139358 A1 * 5/2014 Lee ..... G08G 1/092 340/907
2014/0139539 A1 * 5/2014 Byers ..... G09G 5/10 345/589
2014/0329486 A1 * 11/2014 Choi ..... H04W 4/22 455/404.1
2014/0364081 A1 * 12/2014 Rauner ..... H04L 12/1895 455/404.2
2015/0130350 A1 * 5/2015 Braunstein ..... G09F 13/005 315/86
2015/0253165 A1 * 9/2015 Ajay ..... G01F 1/66 73/28.01
2016/0148417 A1 * 5/2016 Kim ..... G06T 19/006 345/419

FOREIGN PATENT DOCUMENTS

JP 2013242689 A * 12/2013
KR 20-2009-0012978 12/2009
KR 10-2010-0069325 6/2010
KR 10-2012-0081328 7/2012

* cited by examiner

| MESSAGE ID (METADATA ID) |
| --- |
| DS TERMINAL ID INFO |
| EMERGENCY TYPE INFO |
| EMERGENCY LOCATION INFO |
| EMERGENCY TIME INFO |
| EMERGENCY DATA INFO |

FIG. 4

| |
|---|
| MESSAGE ID (METADATA ID) |
| TERMINAL/GROUP ID |
| EMERGENCY TYPE INFO |
| EMERGENCY LEVEL INFO |
| EMERGENCY STATE INFO (STATE SUCH AS OCCURRENCE OR RELEASE) |
| EMERGENCY OCCURRENCE TIME INFO |
| EMERGENCY ANNOUNCEMENT TIME INFO |
| EMERGENCY OCCURRENCE LOCATION INFO |
| EMERGENCY RANGE INFO |
| EMERGENCY MESSAGE (DESCRIPTOR FORM DEFINITION POSSIBLE, TITLE, EMERGENCY DESCRIPTION TEXT, EMERGENCY-RELATED IMAGE INFO, SCREEN COMMENTARY INFO) |
| DISPLAY TYPE INFO |
| SHELTER IDENTIFICATION INFO |
| EVACUATION DIRECTION INDICATION INFO |
| EVACUATION DIRECTION INDICATION SUPPLEMENTARY INFO |
| EVACUATION DISTANCE INFO |
| SHELTER MAP IDENTIFICATION INFO |

FIG. 7

| VALUE | DESCRIPTION OF EVACUATION DIRECTION INDICATION INFORMATION |
|---|---|
| 00 | ⇦ |
| 01 | ⇨ |
| 10 | ⇧ |
| 11 | ⇩ |

| VALUE | DESCRIPTION OF EVACUATION DIRECTION INDICATION SUPPLEMENTARY INFORMATION |
|---|---|
| 00 | UNDEFINED |
| 01 | LEFT TURN |
| 10 | RIGHT TURN |
| 11 | U-TURN |

FIG. 8

DIGITAL SIGNAGE SYSTEM AND EMERGENCY ALERTING METHOD USING SAME

CROSS REFERENCE TO RELATED APPLICATIONS

This application claims the benefit of Korean Patent Application No. 10-2013-0044404 and 10-2014-0039452, filed Apr. 22, 2013 and Apr. 2, 2014, respectively, which are hereby incorporated by reference herein in their entirety.

BACKGROUND OF THE INVENTION

1. Technical Field

The present disclosure relates generally to a digital signage system and a method of providing information using the digital signage system and, more particularly, to a digital signage system for providing an emergency alert and a method of providing an emergency alert using the digital signage system.

2. Description of the Related Art

Digital signage (DS) devices are media playback devices including a display panel that are generally used to perform marketing or advertisement. Since digital signage devices enable display content to be frequently and easily changed, unlike existing signboard advertisements, companies use them to display content created to achieve the promotion of their products and the improvement of their business image. For this purpose, companies have spontaneously installed digital signage devices in places having large floating populations.

Although various types of content and information can be provided when digital signage is used, an infrastructure for digital signage is currently used only for the purposes of simple marketing and advertisement. Digital signage devices are not used for the emergency handling function of transferring an alert to adjacent digital signage terminals via communication with a server.

Accordingly, there is a need for a new emergency alert propagation technology that detects an emergency by collecting surrounding information using digital signage terminals and propagates an emergency alert through the digital signage terminals when an emergency occurs, thereby more effectively propagating an emergency alert using digital signage terminals installed in places having large floating populations.

SUMMARY OF THE INVENTION

At least one embodiment of the present invention is intended to provide an emergency alert to users who use digital signage content by using an infrastructure for digital signage.

In accordance with an aspect of the present invention, there is provided an emergency alert method using a digital signage system, including receiving an emergency message including emergency-related information; identifying at least one digital signage terminal to which the emergency alert message needs to be transferred using the information of the emergency message and the information of a database of a digital signage server; converting the emergency-related information into an emergency alert message in a format supported by the identified digital signage terminal; and transmitting the generated emergency alert message to the identified digital signage terminal.

The emergency alert method may further include generating specific emergency-related evacuation path information using the information of the received emergency message; and the generated emergency alert message may further include the evacuation path information.

The emergency alert method may further include converting the information of the emergency message into voice information; and generating the emergency alert message including the voice information.

The emergency alert method may further include converting the information of the emergency message into sign language video information; and generating the emergency alert message including the sign language video information.

The emergency message may be received from one or more digital signage terminals or a national emergency alert center; and the emergency message may include emergency alert-related data, audience measurement (AM) data, or the surrounding ambient information of the one or more digital signage terminals.

The emergency alert method may further include collecting one or more emergency messages received from the one or more digital signage terminals; analyzing an emergency situation using the collected emergency messages; and generating the emergency alert message using the analyzed emergency situation.

The emergency alert message may include evacuation direction indication information indicative of a direction to a shelter from the location of each of the digital signage terminals.

The emergency alert message may further include shelter direction indication supplementary information including turn information in the direction indicated by the evacuation direction indication information.

The emergency alert message may further include evacuation distance information indicative of a distance in the direction indicated by the evacuation direction indication information.

Identifying the at least one digital signage terminal to which the emergency alert message needs to be transferred may include extracting information about the type of emergency, the urgency of the emergency, the seriousness of the emergency, and an area where the emergency has an influence from the emergency message; and determining the at least one digital signage terminal to which the emergency alert message needs to be transferred based on the extracted information.

In accordance with another aspect of the present invention, there is provided a digital signage terminal, including an emergency detection unit configured to collect surrounding emergency-related information of the digital signage terminal; an emergency detection message generation unit configured to generate an emergency detection message including the collected emergency-related information; a communication unit configured to transmit the generated emergency detection message to a digital signage server, and to receive an emergency alert message including an emergency alert corresponding to an emergency situation from the digital signage server; and an emergency alert message processing unit configured to parse the emergency alert message, and to provide the emergency alert included in the emergency alert message to a user.

The received emergency alert message may further include specific emergency-related evacuation path information; and the emergency alert message processing unit may perform control so that an evacuation path related to the specific emergency is displayed using the evacuation path information.

The emergency alert message processing unit may convert the information of the emergency alert message into voice information, and may perform control so that the voice information is played back.

The emergency alert message processing unit may convert the information of the emergency alert message into sign language video information, and may perform control so that the sign language video information is played back.

The emergency detection message may include emergency alert-related data, AM data, or the surrounding ambient information of the digital signage terminal.

The emergency alert message may include evacuation direction indication information indicative of a direction to a shelter from the location of the digital signage terminal.

The emergency alert message may further include shelter direction indication supplementary information including turn information in the direction indicated by the evacuation direction indication information.

The emergency alert message may further include evacuation distance information indicative of a distance in the direction indicated by the evacuation direction indication information.

The emergency alert message processing unit may perform control so that evacuation path information previously stored in the digital signage terminal is displayed in accordance with an emergency situation based on information included in the emergency alert message.

The digital signage terminal may check the remaining power of the digital signage terminal, and may adjust the display brightness of the digital signage terminal to a lower value if the remaining power is lower than a threshold value.

BRIEF DESCRIPTION OF THE DRAWINGS

The above and other objects, features and advantages of the present invention will be more clearly understood from the following detailed description taken in conjunction with the accompanying drawings, in which:

FIG. 4 is a diagram illustrating an emergency detection message according to an embodiment of the present invention;

FIG. 7 is a diagram illustrating an emergency alert message according to an embodiment of the present invention;

FIG. 8 is a diagram illustrating the details of evacuation direction indication information and evacuation direction indication supplementary information according to an embodiment of the present invention.

DESCRIPTION OF THE PREFERRED EMBODIMENTS

Figure 1:
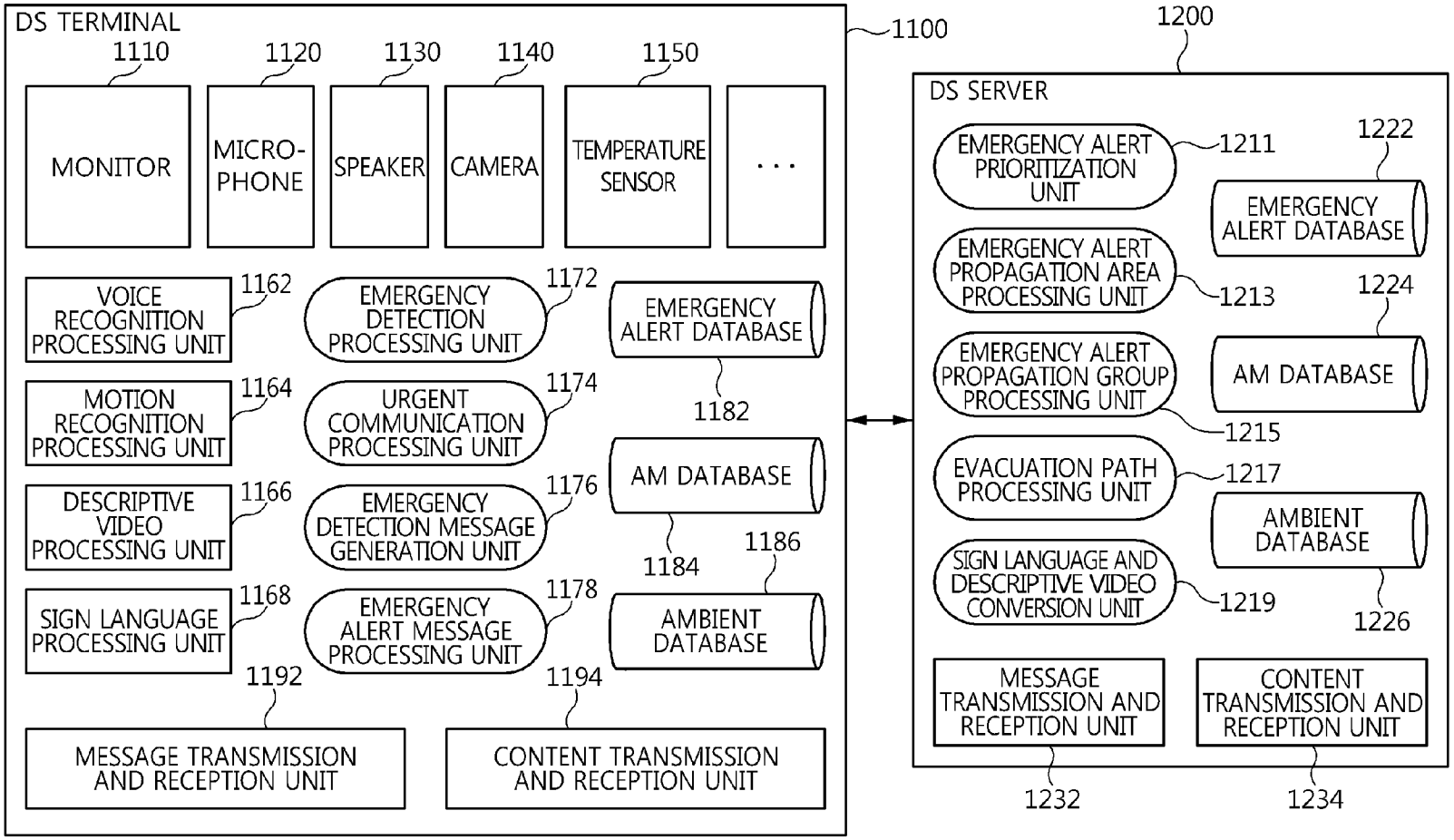
FIG. 1 is a diagram illustrating a digital signage terminal and a digital signage server according to an embodiment of the present invention.

Embodiments of the present invention are described below with reference to the accompanying drawings, but the present invention is not limited to the embodiments.

Prior to the following detailed description of the present invention, it should be noted that the terms and words used in the specification and the claims should not be construed as being limited to ordinary meanings or dictionary definitions. Meanwhile, the embodiments described in the specification and the configurations illustrated in the drawings are merely examples and do not exhaustively present the technical spirit of the present invention. Accordingly, it should be appreciated that there may be various equivalents and modifications that can replace the embodiments and the configurations at the time at which the present application is filed.

FIG. 1 is a diagram illustrating a digital signage terminal 1100 and a digital signage server 1200 according to an embodiment of the present invention.

The digital signage terminal 1100 according to this embodiment of the present invention includes a monitor 1110, a microphone 1120, a speaker 1130, a camera 1140, a temperature sensor 1150, a voice recognition processing unit 1162, a motion recognition processing unit 1164, a descriptive video processing unit 1166, a sign language processing unit 1168, an emergency detection processing unit 1172, an urgent communication processing unit 1174, an emergency detection message generation unit 1176, an emergency alert message processing unit 1178, an emergency alert database 1182, an AM database 1184, an ambient database 1186, a message transmission and reception unit 1192, and/or a content transmission and reception unit 1194.

The monitor 1110 displays content. The content includes not only general digital signage content, such as an advertisement, marketing content, user experience, etc., but also an emergency alert message.

The microphone 1120 collects the audio information of the place where the digital signage terminal is located.

The speaker 1130 plays back an audio signal related to content played back by the digital signage terminal.

The camera 1140 collects images (or videos) of the place where the digital signage terminal is located.

The temperature sensor 1150 collects the temperature information of the place where the digital signage terminal is located.

The voice recognition processing unit 1162 collects voice information input to the place where the digital signage terminal is located. For example, the above-described microphone 1120 may be used when bidirectional voice communication between the digital signage terminal and the digital signage server is required. In contrast, the voice recognition processing unit 1162 may be responsible for the function of collecting the adjacent voice information of the place where the digital signage terminal is located while operating.

The motion recognition processing unit 1164 collects information about the motion of an object or a human in the place where the digital signage terminal is located. For example, the motion recognition processing unit 1164 may collect motion information, such as the speed of movement of an object or a human and the hand gesture of a human.

The descriptive video processing unit 1166 performs a function related to the descriptive video of the digital signage terminal. For example, the descriptive video processing unit 1166 may perform control in order to convert text displayed on the digital signage terminal into a voice signal to be thus played back via the speaker.

The sign language processing unit 1168 performs a function related to the sign language broadcasting of the digital signage terminal. For example, the sign language processing unit 1168 may decode a signal for a sign language broadcast. The sign language processing unit 1168 may convert a voice signal into content for a sign language broadcast.

The above-described voice recognition processing unit 1162, the motion recognition processing unit 1164, the descriptive video processing unit 1166, and/or the sign language processing unit 1168 may be included in a single apparatus, which may be named an "emergency information collection processor." In this case, the emergency information collection processor may further include a microphone 1120, a camera 1140, and a temperature sensor 1150.

The emergency detection processing unit 1172 determines whether an emergency has occurred and a plurality of emergency-related information based on information collected in a place where the digital signage terminal is located. For example, the emergency detection processing unit 1172 determinates whether an emergency has occurred based on information collected by any one of the devices included in the emergency information collection processor. The emergency detection processing unit 1172 may determine the type of emergency based on information collected by the emergency information collection processor.

The urgent communication processing unit 1174 may perform processing related to urgent communication between the digital signage terminal and the digital signage server. The urgent communication processing unit 1174 may perform processing related to urgent communication between the digital signage terminal and a national emergency alert center. For example, if an emergency alert has occurred, the urgent communication processing unit 1174 may perform urgent communication using only the identification and location information of the digital signage terminal. The urgent communication processing unit 1174 may perform general control required to transmit an emergency detection message to the digital signage server or a national emergency alert center or to receive an emergency alert message from the digital signage server or a national emergency alert center. For example, the urgent communication processing unit 1174 may classify the type of message, and may determine whether the corresponding message will be transmitted to the national emergency alert center or digital signage server.

The emergency detection message generation unit 1176 generates information, in the form of a message, about an emergency having occurred in the place where the digital signage terminal is located. The emergency detection message generation unit 1176 may receive information from the emergency information collection processor and/or emergency detection processing unit 1172, and may generate an emergency detection message by encoding the information in the form of an emergency detection message.

The emergency alert message processing unit 1178 parses the received emergency alert message, and functions to perform control so that a corresponding emergency alert is displayed on the monitor 1110.

The emergency detection processing unit 1172, the urgent communication processing unit 1174, the emergency detection message generation unit 1176, and/or the emergency alert message processing unit 1178 may be included in a single apparatus, which may be named an emergency alert processing unit.

The emergency information database 1182 stores emergency information-related data.

The AM database 1184 stores audience measurement (AM)-related information.

The ambient database 1186 stores data related to information about the surroundings of the digital signage terminal.

The emergency information database 1182, the AM database 1184, and/or the ambient database 1186 may be included in a single database.

The message transmission and reception unit 1192 is a communication interface that transmits an emergency detection message or receives an emergency alert message.

The content transmission and reception unit 1194 is a communication interface that transmits or receives digital signage content, an emergency detection message or emergency information within an emergency alert message.

The digital signage server 1200 according to the embodiment of the present invention includes an emergency alert prioritization unit 1211, an emergency alert propagation area processing unit 1213, an emergency alert propagation group processing unit 1215, an evacuation path processing unit 1217, a sign language and descriptive video conversion unit 1219, an emergency information database 1222, an AM database 1224, an ambient database 1226, a message transmission and reception unit 1232, and/or a content transmission and reception unit 1234.

The emergency alert prioritization unit 1211 functions to determine the priority of an emergency alert and to convert the determined priority into data. For example, the emergency alert prioritization unit 1211 may determine the type of emergency based on information received from the digital signage terminal and/or a national emergency alert center, and assigns a priority to a corresponding emergency alert based on the urgency of a corresponding emergency.

The emergency alert propagation area processing unit 1213 determines an area to which the emergency alert message needs to be transmitted. For example, the emergency alert propagation area processing unit 1213 may set an area where an emergency has directly occurred as the area to which the emergency alert message needs to be transmitted. The emergency alert propagation area processing unit 1213 may set an area where an emergency has not directly occurred but the emergency has an indirect influence as the area to which the emergency alert message needs to be transmitted.

The emergency alert propagation group processing unit 1215 detects one or more digital signage terminals in the area to which an emergency alert message needs to be transmitted, and extracts the identification information of the digital signage terminals. In the case of an emergency alert that has occurred in a specific area, the emergency alert propagation group processing unit 1215 may manage one or more digital signage terminals located in the specific area and an organization adapted to be responsible for emergency countermeasures in the corresponding area as a single group so that an emergency alert message may be transferred not only to the digital signage terminals located in the corresponding area but also the organization adapted to be responsible for emergency countermeasures in the corresponding area.

The evacuation path processing unit 1217 functions to calculate an evacuation path in a specific area. For example, the evacuation path processing unit 1217, when an emergency has occurred in a large-scale shopping/culture complex, may calculate a path to an emergency exit or a shelter closest to a specific digital signage terminal in the corresponding shopping/culture complex. Alternatively, the evacuation path processing unit 1217 may determine whether to escape from a building or move to a safe shelter within the building based on the type of emergency, and may generate path information about the escape or movement to the shelter.

The sign language and descriptive video conversion unit 1219 may function to generate sign language content or descriptive video content for an emergency alert. For example, the sign language and descriptive video conversion unit 1219 may generate content describing information within an emergency alert message in a sign language, or may generate information within an emergency alert message in voice.

The emergency alert prioritization unit 1211, the emergency alert propagation area processing unit 1213, the emergency alert propagation group processing unit 1215, the evacuation path processing unit 1217, and/or the sign language and descriptive video conversion unit 1219 may be included in a single apparatus, which may be named an "emergency alert message generation unit." The emergency alert message generation unit functions to generate an emergency alert message using the functions of the above-described devices.

The emergency information database 1222 stores the emergency information-related data received from the digital signage terminal.

The AM database 1224 stores AM-related information received from the digital signage terminal.

The ambient database 1226 stores the data related to the information about the surroundings of the digital signage terminal received from the digital signage terminal.

The emergency information database 1222, the AM database 1224, and the ambient database 1226 may be included in a single database.

The message transmission and reception unit 1232 is a communication interface that transmits an emergency alert message to the digital signage terminal or receives an emergency detection message from the digital signage terminal or a national emergency alert center.

The content transmission and reception unit 1234 is a communication interface that transmits or receives digital signage content, and/or an emergency detection message or emergency information with an emergency alert message.

Figure 2:
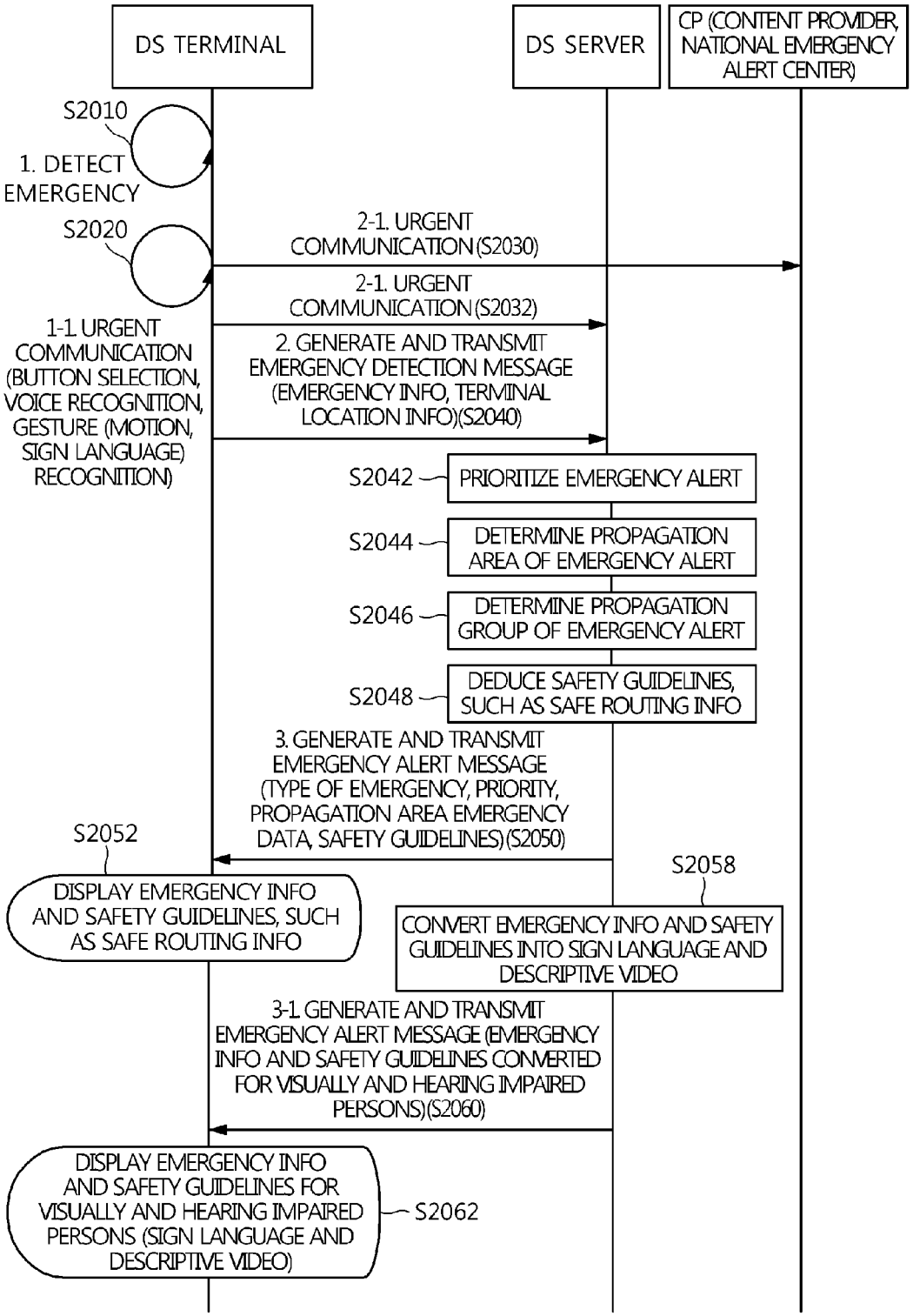
FIG. 2 is a diagram illustrating an emergency alert method using a digital signage system according to an embodiment of the present invention.

FIG. 2 is a diagram illustrating an emergency alert method using a digital signage system according to an embodiment of the present invention.

The digital signage terminal detects the occurrence of an emergency around itself at step S2010. In this case, the digital signage terminal may detect an emergency using at least one or more devices included in the above-described digital signage terminal.

The digital signage terminal may perform processing for urgent communication at step S2020. In this case, the urgent communication may be performed by the selection of a user located around the digital signage terminal. Furthermore, the urgent communication may be automatically performed in response to the emergency detection of the digital signage terminal. The processing for urgent communication may include the packing of information collected by the digital signage terminal in a transmission form and/or setting the counterpart of urgent communication.

The digital signage terminal may perform urgent communication with a content provider or a national emergency alert center at step S2030. For example, via urgent communication, the occurrence of an emergency-related raw data collected by the digital signage terminal may be transmitted. Alternatively, the digital signage terminal may perform urgent communication with the digital signage server. For example, the digital signage terminal may transmit the occurrence of an emergency-related raw data collected by the digital signage terminal to the digital signage server via urgent communication at step S2032.

The digital signage terminal may generate an emergency detection message and transmit the emergency detection message to the digital signage server at step S2040. The generated emergency detection message will be described later.

The digital signage server prioritizes the emergency alert using information included in the emergency detection message at step S2042. The digital signage server determines an area requiring the transmission of the emergency alert at step S2044. The digital signage server determines digital signage terminals or propagation group requiring the transmission of the emergency alert at step S2046. The digital signage server calculates an optimum evacuation path in the corresponding area at step S2048. The digital signage server generates and transmits an emergency alert message including generated information to the digital signage terminals or propagation group at step S2050. The emergency alert message will be described in detail later.

Each of the digital signage terminals parses emergency-related information from the emergency alert message and then displays the emergency-related information on a monitor. For example, the digital signage terminal may display the content of the emergency alert message in the form of text, or may display an emergency-related evacuation path or emergency-related safety guidelines at step S2052.

The digital signage server may convert information, such as emergency information, emergency-related safety guidelines, and/or an evacuation path, included in the emergency alert message into a sign language video or voice content at step S2058, and may transmit the information to the digital signage terminal at step S2060.

The digital signage terminal may receive and play back the above-described sign language video or voice content at step S2062.

Figure 3A:
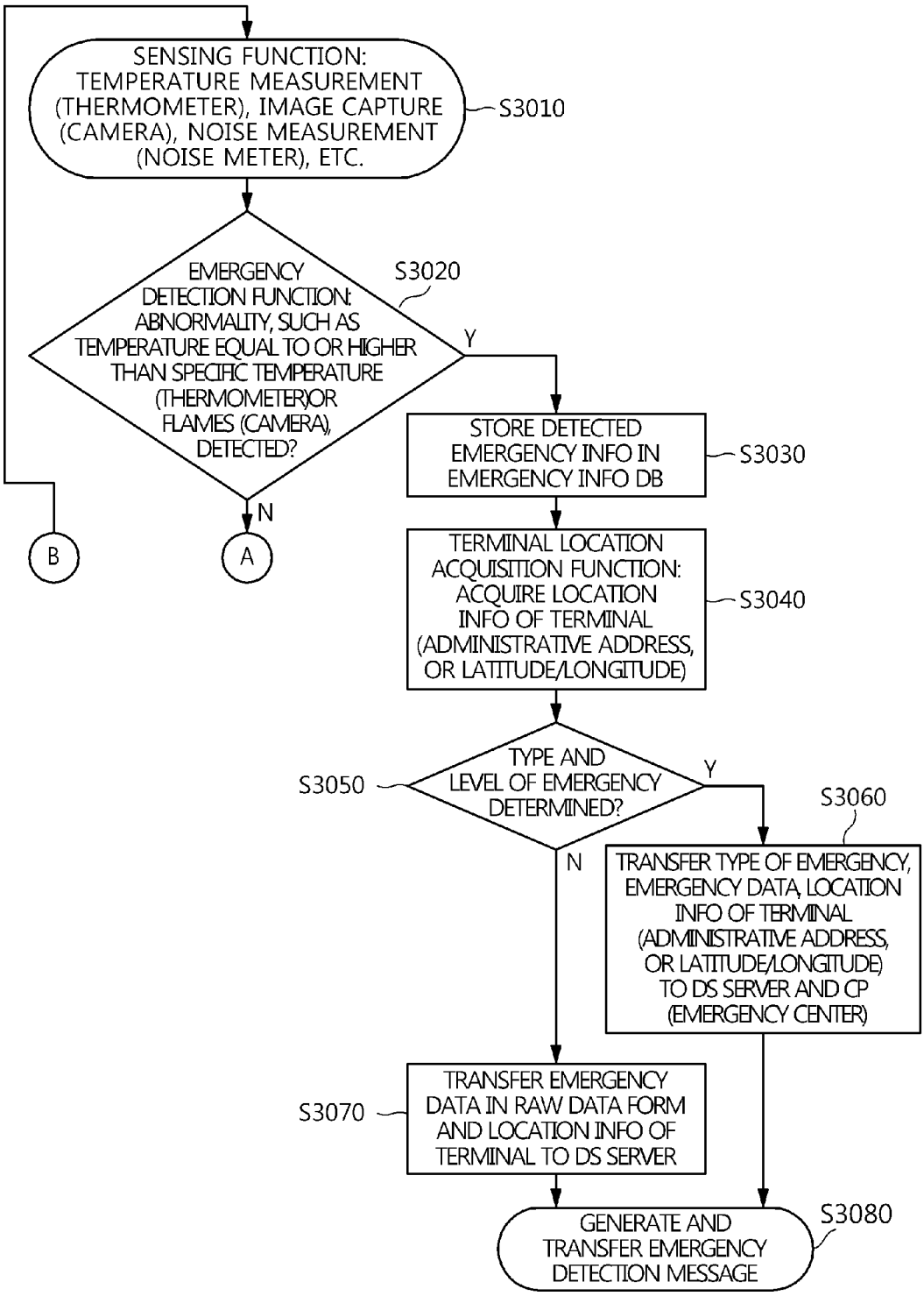
FIGS. 3A and 3B are diagrams illustrating an emergency alert method using a digital signage system according to another embodiment of the present invention.
Figure 3B:
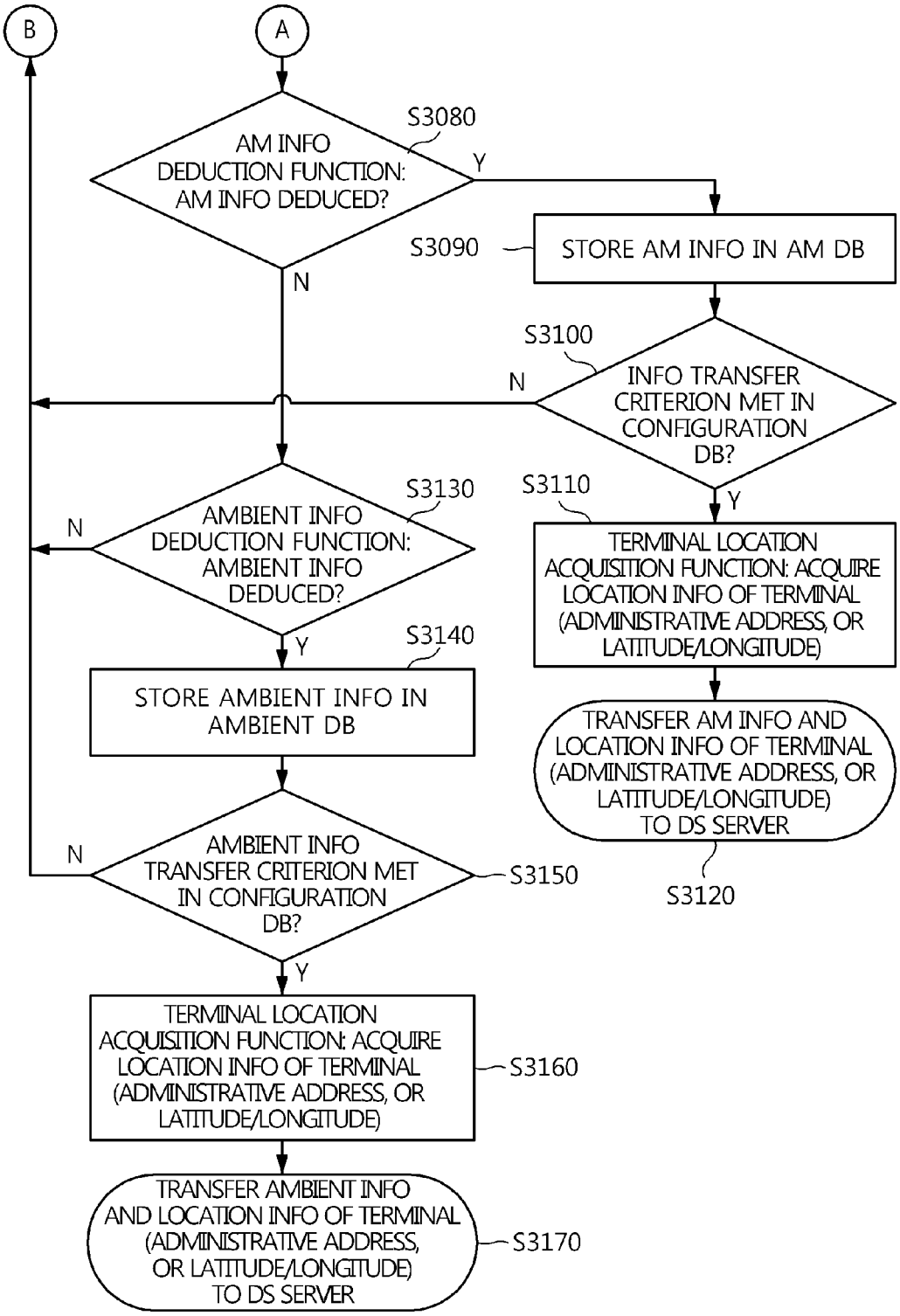

FIGS. 3A and 3B are diagrams illustrating an emergency alert method using a digital signage system according to another embodiment of the present invention.

A digital signage terminal may detect the ambient situation of the digital signage terminal using the above-described emergency information collection processor at step S3010. For example, the digital signage terminal may measure ambient temperature, capture an image of its ambient situation, measure ambient noise, record ambient conversation, or detect the motion of an adjacent object or human.

The digital signage terminal may determine whether an abnormality has occurred using the detected ambient situation at step S3020. For example, the digital signage terminal may determine that an abnormality has occurred if ambient temperature is equal to or higher than a predetermined temperature, if a sudden change has occurred in an image of an ambient situation based on a normal situation, if ambient noise is at a level equal to or higher than a predetermined level, if a word indicative of an emergency situation has been detected in ambient conversation, or if the motion of an adjacent object or human is faster than its normal motion.

The digital signage terminal stores detected emergency information in a database at step S3030.

The digital signage terminal encodes information about a place where the digital signage terminal is located at step S3040. For example, the digital signage terminal encodes information about the administrative address or latitude/longitude of a place where the digital signage terminal is located.

The digital signage terminal determines the type of emergency and determines whether an emergency situation has been identified using the detected emergency information at step S3050.

If the digital signage terminal can identify the type of emergency and the situation of the emergency using the detected emergency information, the digital signage terminal may transmit the identified information, the emergency-related data, the location information of the terminal to the digital signage server, a content provider, or a national emergency alert center. In this case, if the digital signage terminal can identify the type of emergency and the situation of the emergency using the detected emergency information, the digital signage terminal may generate an emergency detection message and transmit the emergency detection message to the digital signage server, content provider or national emergency alert center at step S3180. In this case, step S3060 may be omitted.

If the digital signage terminal cannot determine the type of emergency and the situation of the emergency using the detected emergency information, the digital signage terminal may transmit information about the location of the digital signage terminal and the detected emergency information to the digital signage server, content provider, or national emergency alert center in the form of raw data at step S3070. The digital signage terminal may transfer surrounding ambient information (for example, video information and sound information) for a specific period to the digital signage server or the like, so that a server administrator or the like can determine the situation of the emergency. In this case, the digital signage terminal may generate an emergency detection message including identifiable emergency-related information using the detected emergency information and transmit the emergency detection message to the digital signage server, content provider or national emergency alert center at step S3180. In this case, step S3070 may be omitted.

The digital signage terminal determines whether AM information can be deduced from the detected ambient situation information at step S3080.

Once the AM information has been deduced, the digital signage terminal stores the AM information in a database at step S3090, and determines whether the derived AM information is worth being transmitted as AM information at step S3100. In this case, in order to transfer AM information, a predetermined criterion may be provided, and only AM information meeting this criterion may be determined to be AM information worth being transmitted.

If the AM information meets the transfer criterion, the digital signage terminal extracts the identification information and/or location information of the terminal at step S3110, and transmits the extracted information to the digital signage server along with the AM information at step S3120. If the AM information does not meet the transfer criterion, the digital signage terminal continues to monitor the ambient situation of the digital signage terminal using the above-described emergency information collection processor at step S3010.

The digital signage terminal determines whether ambient information can be deduced from the detected surrounding situation information at step S3130. If ambient information cannot be deduced, the digital signage terminal continues to monitor the surrounding situation of the digital signage terminal using the above-described emergency information collection processor at step S3010. If ambient information can be deduced, the digital signage terminal determines whether the deduced ambient information is worth being transferred as ambient information at step S3150. In this case, in order to transfer the ambient information, a predetermined criterion may be present, and only ambient information meeting this criterion may be determined to be ambient information worth being transferred. If the ambient information meets the transfer criterion, the digital signage terminal extracts the identification information and/or location information of the terminal at step S3160, and transmits the extracted information to the digital signage server along with the ambient information at step S3170. If the ambient information does not meet the transfer criterion, the digital signage terminal continues to monitor the ambient situation of the digital signage terminal using the above-described emergency information collection processor at step S3010. In this case, the ambient information corresponds to surrounding environmental information collected by the digital signage terminal.

FIG. 4 is a diagram illustrating an emergency detection message according to an embodiment of the present invention.

The emergency detection message according to this embodiment of the present invention may include a message ID (or a metadata ID), DS terminal ID information, emergency type information, emergency location information, emergency time information, and/or emergency data information.

The message ID is information that is used to identify a message. For example, if a specific value has been designated for an emergency detection message, the digital signage terminal or digital signage server may identify the corresponding message as an emergency detection message based on the corresponding specific value.

The DS terminal ID information is an ID that is used to identify the digital signage terminal. For example, the digital signage terminal may have its unique identification number. The digital signage terminal includes its unique identification number in an emergency detection message while generating the emergency detection message, thereby enabling a location at or from which the emergency detection message is generated or transmitted to be determined.

The emergency type information is indicative of the type of emergency. For example, the emergency may correspond to at least any one of an earthquake, a fire, a typhoon, a heavy rain, a heavy flood, a cold wave, a riot, a traffic accident, the outbreak of a contagious disease, a landslide, a volcanic eruption, the outbreak of war, the collapse of a building, the collapse of a structure, a terror, etc. A unique value may have been designated for each type of emergency, and an emergency detection message may be generated by including a unique value indicative of a corresponding emergency in emergency type information based on the type of emergency.

The emergency location information is information that is indicative of a location where an emergency has occurred. The emergency location information may be information that is indicative of a place where the digital signage terminal is located.

The emergency time information is indicative of the time at which an emergency detection message is generated. As another example, the emergency time information may be indicative of the time at which the digital signage terminal performs emergency-related detection before the digital signage terminal generates an emergency detection message.

The emergency data information includes emergency-related information collected by the digital signage terminal. For example, the emergency data information may be defined as a descriptor for transmitting the raw data of emergency-related information collected by the above-described emergency information collection processor.

Figure 5:
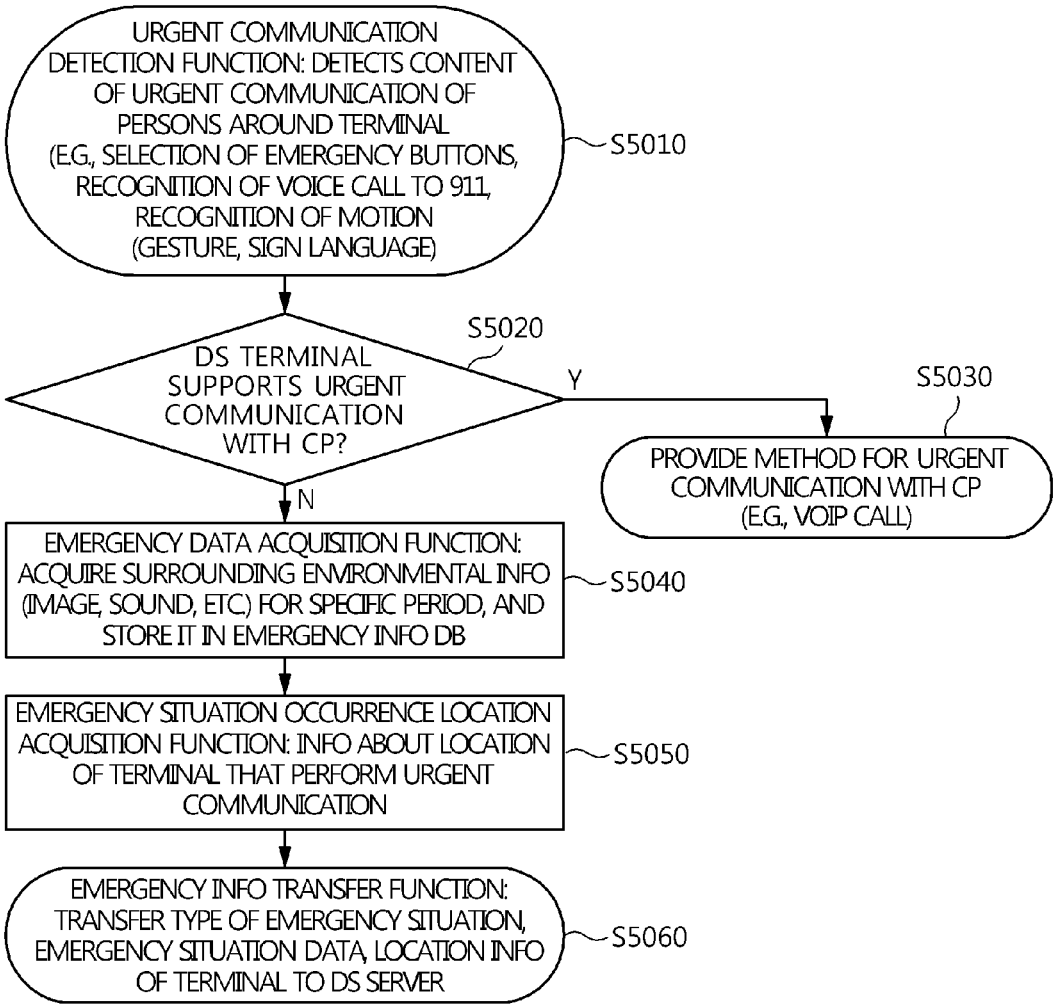
FIG. 5 is a flowchart of a process in which the digital signage terminal performs urgent communication and transfers an emergency detection message according to an embodiment of the present invention.

FIG. 5 is a flowchart of a process in which the digital signage terminal performs urgent communication and transfers an emergency detection message according to an embodiment of the present invention.

The digital signage terminal detects a need for urgent communication at step S5010. For example, it may be possible to receive input that is performed when a human around the terminal presses an urgent communication button provided in the digital signage terminal and then performs urgent communication. As another example, when the voice recognition processing unit of the digital signage terminal detects a voice, such as "911," "emergency" or "fire," or scream of an adjacent human, control may be performed such that the digital signage terminal immediately performs urgent communication. As another example, when the digital signage terminal recognizes a motion or a sign language indicative of an emergency situation, control may be performed such that the digital signage terminal immediately performs urgent communication.

It is determined whether the digital signage terminal can perform urgent communication with the digital signage server, a content provider or a national emergency alert center at step S5020. If it is determined that the digital signage terminal can perform urgent communication with the digital signage server, a content provider or a national emergency alert center, the digital signage terminal immediately initiates urgent communication at step S5030. In this case, the digital signage terminal may transfer detected information or information about the button input of an adjacent human, which is the cause of the initiation of the urgent communication, to the counterpart of the urgent communication.

If it is determined that the digital signage terminal cannot perform urgent communication with the digital signage server, a content provider or a national emergency alert center, the digital signage terminal continues to collect information about the surroundings of the digital signage terminal and stores the collected information in a database with the digital signage terminal at step S5040. The digital signage terminal may store all information detected by the emergency information collection processor in the database.

The digital signage terminal acquires a location where the emergency has occurred at step S5050. For example, the digital signage terminal may use information about the location of the digital signage terminal that has detected the emergency as information about the location of the emergency. The corresponding location information may be represented in the form of an administrative address, latitude/longitude, or the like.

The digital signage terminal may transfer information about the emergency to the digital signage server. The information about the emergency may be transferred in the form of an emergency detection message. Alternatively, the information about the emergency may be transferred to the digital signage server with the type of emergency, emergency data and/or information about the location of terminal included therein.

Figure 6A:
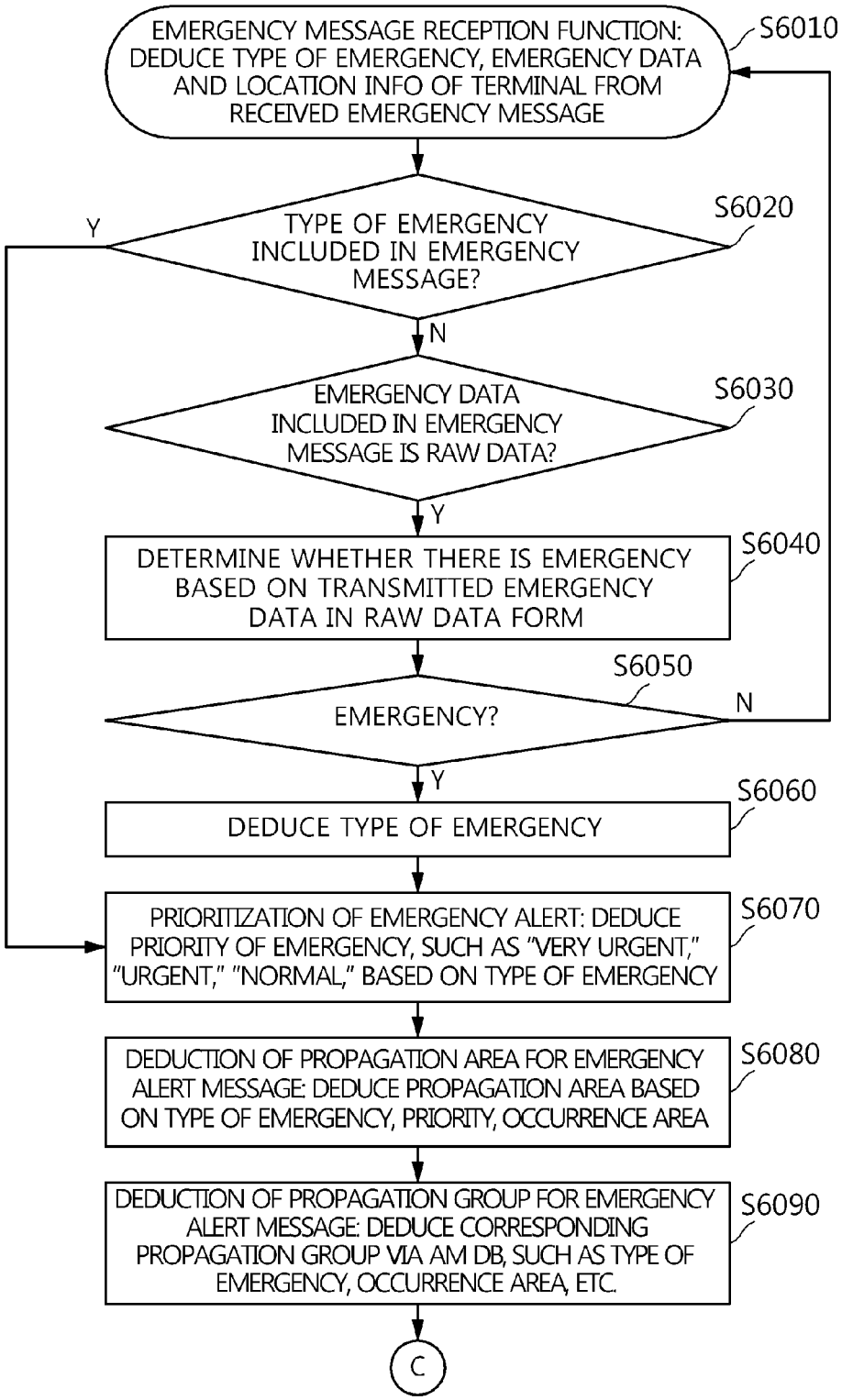
FIGS. 6A and 6B are flowcharts illustrating a process in which the digital signage server generates and transfers an emergency alert message according to an embodiment of the present invention.
Figure 6B:
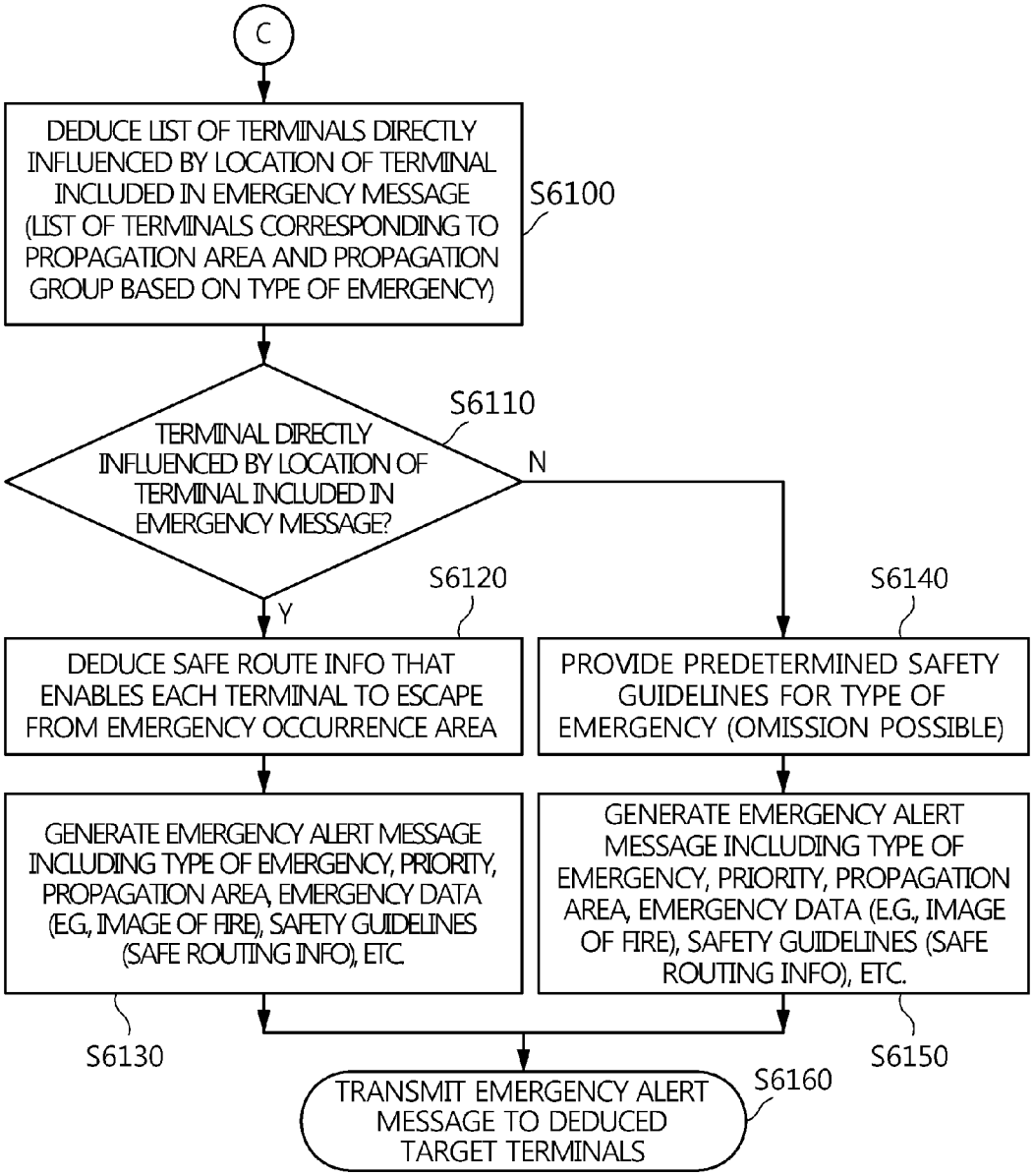

FIGS. 6A and 6B are flowcharts illustrating a process in which the digital signage server generates and transfers an emergency alert message according to an embodiment of the present invention.

The digital signage server receives an emergency message at step S6010. The emergency message may be generated by the digital signage terminal or an emergency alert center and then transmitted to the digital signage server, as described above. The digital signage server extracts the type of emergency, emergency data and/or information about the location of the terminal from the emergency message.

The digital signage server determines whether information indicative of the type of emergency is included in the emergency message at step S6020. If information about the type of emergency is not included or is not clearly indicated in the emergency message, the digital signage server parses emergency data included in the emergency message and determines whether the emergency data is the raw data of the emergency detection information at step S6030. In the case of an emergency message received from the digital signage terminal, the digital signage server checks the ambient situation of the digital signage terminal using raw data or emergency data at step S6040, and determines whether the ambient situation is an emergency at step S6050. If it is determined that the ambient situation is an emergency, the digital signage server deduces the type of emergency at step S6060.

In the case of the emergency message received from the digital signage terminal, the digital signage server prioritizes an emergency alert at step S6070. The priority of the emergency alert may be determined based on the type of emergency, and may be classified into "very urgent," "urgent," "normal," and/or "requiring close monitoring."

The digital signage server extracts a group or one or more digital signage terminals to which an emergency alert message needs to be transferred at step S6080. For example, the digital signage server may extract the size and location of an area to which the emergency alert message needs to be transferred and a group of digital signage terminals or digital signage terminals included in the corresponding area based on information such as the type of emergency, priority, and/or an area of occurrence.

The digital signage server may extract a group or one or more digital signage terminals to which the emergency alert message needs to be transferred using the AM information at step S6090. If the group or digital signage terminals to which the emergency alert message needs to be transferred have been sufficiently extracted at the previous step, this step may be omitted.

The digital signage server checks the locations of the terminals included in the emergency message, thereby identifying a group or one or more digital signage terminals that may be directly influenced by the emergency when the emergency has occurred at a corresponding location at step S6100.

The digital signage server extracts an evacuation path for the evacuation of the emergency occurrence area for each of the terminals or group that are directly influenced by the emergency at step S6120. Such evacuation paths may be defined based on the types of emergencies, the locations of shelters and/or the location of terminals and stored in the digital signage server in advance.

The digital signage server generates an emergency alert message including information such as the type of emergency, the priority, the propagation area of the emergency alert message, emergency data (for example, a photo of a fire), and safety guidelines (for example, safe evacuation path) at step S6130.

The digital signage server transmits the generated emergency alert message to the group or digital signage terminals to which the emergency alert message needs to be transferred at step S6160.

The digital signage server may provide information about safety guidelines redefined for each type of emergency to a group or one or more digital signage terminals that are not directly influenced by the emergency at step S6140. The digital signage server may generate an emergency alert message including information such as the type of emergency, priority, a propagation area, emergency data (for example, a photo of a fire), and/or safety guidelines (for example, safe evacuation path) at step S6150, and may transmit the generated emergency alert message to the group or digital signage terminals to which the emergency alert message needs to be transferred at step S6160.

FIG. 7 is a diagram illustrating an emergency alert message according to an embodiment of the present invention.

The emergency alert message according to this embodiment of the present invention may include a message ID, a terminal/group ID, emergency type information, emergency level information, emergency state information, emergency occurrence time information, emergency announcement time information, emergency occurrence location information, emergency range information, emergency message, display type information, shelter identification information, evacuation direction indication information, evacuation direction indication supplementary information, evacuation distance information, and/or shelter map identification information.

This message ID is information that identifies a message. The message ID has a specific value so that the digital signage terminal can identify a corresponding message as an emergency alert message.

The terminal/group ID is the identification information of a digital signage terminal and/or the identification information of a group including a plurality of digital signage terminals to which the emergency alert message needs to be transmitted. The digital signage terminal may determine whether it needs to parse the corresponding emergency alert message using the information.

The emergency type information is indicative of the type of emergency. For example, the emergency may correspond to at least any one of an earthquake, a fire, a typhoon, a heavy rain, a heavy flood, a cold wave, a riot, traffic accident, the outbreak of a contagious disease, a landslide, a volcanic eruption, the outbreak of war, the collapse of a building, the collapse of a structure, a terror, etc. A unique value may have been designated for each type of emergency, and an emergency detection message may be generated by including a unique value indicative of a corresponding emergency in emergency type information based on the type of emergency.

The emergency level information is indicative of the level of urgency of an emergency. For example, the emergency level information may be indicative of information, such as "very urgent," "urgent," "cautious," "normal," and/or "requiring the monitoring of a change in situation."

The emergency state information is indicative of an emergency-related current situation. For example, the emergency state information may be indicative of the state in which an emergency has occurred, the state in which an emergency is currently ongoing, the state in which an emergency situation has been released, and the state in which the possibility of an emergency is present.

The emergency occurrence time information is indicative of information about the time at which the emergency occurs. For example, the emergency occurrence time information may be indicative of the time identical to emergency time information included in an emergency message that is the cause of the generation of an emergency alert message.

The emergency announcement time information is information that is indicative of the time at which the emergency has been announced as an emergency. For example, the emergency announcement time information may be indicative of the time at which a national emergency alert center or like announces a specific situation as an emergency. As another example, the emergency announcement time information may be indicative of information about the time at which the emergency alert message is generated.

The emergency occurrence location information includes information about a location at which an emergency occurs. For example, the emergency occurrence location information may include an administrative address, adjacent building information, and/or latitude/longitude related to an emergency occurrence location.

The emergency range information is information that is indicative of a range in which an emergency has an influence. For example, the emergency range information is indicative of whether the location of the digital signage terminal falls within a range in which an emergency has a direct influence, a range in which an emergency has an indirect influence, and/or a range in which an emergency has no influence.

The emergency message includes emergency-related data. For example, the emergency message may include text data on the details of the emergency, image data about the emergency, Internet address information for the provision of additional information about the emergency, and/or data for descriptive video in voice.

The display type information is indicative of a mode in which an emergency alert is displayed. For example, the display type information may be indicative of an emergency mode, in which case existing digital signage content is terminated and only emergency alert-related content is played back. The display type information may be indicative of parallel mode, in which case digital signage content and emergency-related content may be played back together. The display type information may be indicative of standby mode, in which case an indication that emergency alert-related content can be played back is displayed on a screen and corresponding content may be played back only when a request for the playback of the emergency alert-related content is received from a human around the digital signage terminal.

The shelter identification information is information that identifies a place for evacuation from an emergency. For example, the shelter identification information may be information that identifies an exit, an underground bunker, or a specific shelter.

The evacuation direction indication information is indicative of the indication of the direction of movement to a shelter that needs to be displayed on the digital signage terminal.

The evacuation direction indication supplementary information is indicative of the supplementary indication of the direction of movement to a shelter that needs to be displayed on the digital signage terminal.

The evacuation distance information is indicative of the distance of movement in the corresponding direction along with an evacuation direction indication.

The shelter map identification information is information that is indicative of a map on which a shelter or a shelter is indicated. For example, the digital signage terminal may store a map on which a shelter is indicated based on each emergency situation, and may display a specific map indicated by the shelter map identification information.

FIG. 8 is a diagram illustrating the details of evacuation direction indication information and evacuation direction indication supplementary information according to an embodiment of the present invention.

In a department store, there are digital signage terminals for providing shop information and digital signage terminals functioning as sign boards indicative of restrooms and directions. Digital signage terminals function to display emergency information to customers when an emergency, such as a fire, occurs in a specific shop. When an emergency, such as a fire, occurs, the digital signage server notifies all digital signage terminals installed in the department store and influenced by the emergency of an emergency situation, thereby allowing them to operate in emergency mode. The digital signage server notifies customers of emergency information. Furthermore, the digital signage server provides emergency path information for the evacuation of customers in addition to the emergency information. The emergency path information provided in this situation is fixed information in which a current emergency situation is not reflected and which was previously acquired and stored. In this case, emergency information and emergency path information are provided to visually or hearing impaired persons through a descriptive video and sign language broadcast.

An employee or a customer who is present in an area in which an emergency, such as a fire, occurs notifies the digital signage server and an urgent emergency alert center of the occurrence of the emergency using the urgent communication function of a digital signage terminal. In this case, voice recognition, motion recognition, gesture recognition and touch screen input are enabled such that visually and hearing impaired person can access urgent communication.

Meanwhile, if there is no employee or customer in the area in which the emergency occurs but there is a sensing device, such as a thermometer or a camera, the digital signage terminal may become aware of the detection of a specific abnormality in temperature and the detection of flames using the camera and automatically transmit emergency information detection information to the digital signage server. The digital signage server newly generates emergency path information operative to allow customers to avoid and rapidly evacuate the place of the emergency based on the location of each terminal, and provides it.

If a surrounding environment becomes dark because it is difficult to supply power because of a serious emergency situation, the digital signage terminals control brightness so that customers or employees can become aware of emergency information or an emergency path. Thereafter, if power is completely cut off, the digital signage terminals provide emergency path information that has been finally provided.

A large-scale shopping/culture complex is generally very complicated. Accordingly, if a person is not one who frequently has visited the corresponding complex, it is difficult for the person to go to a shelter using only a simply displayed map of the corresponding complex. Furthermore, in an emergency situation, it is not easy for people to recognize a map displayed on the digital signage terminals and go to a shelter. Accordingly, the plurality of digital signage terminals may indicate the directions from corresponding locations to the shelter using arrows, and people in an emergency situation simply move in accordance with the direction indications, thereby safely finding the shelter.

Accordingly, the evacuation direction indication information according to the present invention, which is displayed on the digital signage terminals, may include a left direction arrow, a right direction arrow, an upper direction arrow and/or a lower direction arrow based on their value.

The digital signage server may designate a shelter for each emergency situation in advance. For example, for an emergency such as a typhoon or a hurricane, it may be possible to designate a shelter so that people do not exit from the large-scale shopping/culture complex and stay at a safe location within the corresponding complex. As another example, for an emergency, such as a fire in the complex, or an earthquake, an exit may be designated as the shelter so that persons can exit from the complex. Arrow directions to each shelter, which need to be displayed by the digital signage terminal at a corresponding location, may be previously set and stored in the digital signage server. Accordingly, the digital signage server may transfer predetermined evacuation direction indication information values to each digital signage terminal based on the type of emergency and/or the location of a corresponding shelter.

The evacuation direction indication supplementary information may be indicative that a left turn, a right turn, a U turn or evacuation direction indication supplementary information is not defined. The evacuation direction indication supplementary information may be used in combination with the evacuation direction indication information. For example, when the digital signage terminal receives evacuation direction indication information indicative of a left arrow direction and evacuation direction indication supplementary information indicative of a left turn, arrows indicative of moving in the left direction and then making a left turn may be displayed on a screen.

Additionally, the evacuation distance information included in the emergency alert message may be used along with the evacuation direction indication information and/or the evacuation direction indication supplementary information. For example, when evacuation direction indication information indicative of a left arrow direction is received, evacuation direction indication supplementary information indicative of a left turn is received and then evacuation distance information indicative of 100 m is received, the digital signage terminal may display an arrow direction indication and a distance indication indicative of moving to the left direction and then making a left turn 100 m ahead.

At least one embodiment of the present invention is advantageous in that a plurality of digital signage terminals installed in a specific place performs evacuation direction indications, thereby preventing people from being confused and enabling people to rapidly escape to a shelter.

Figure 9:
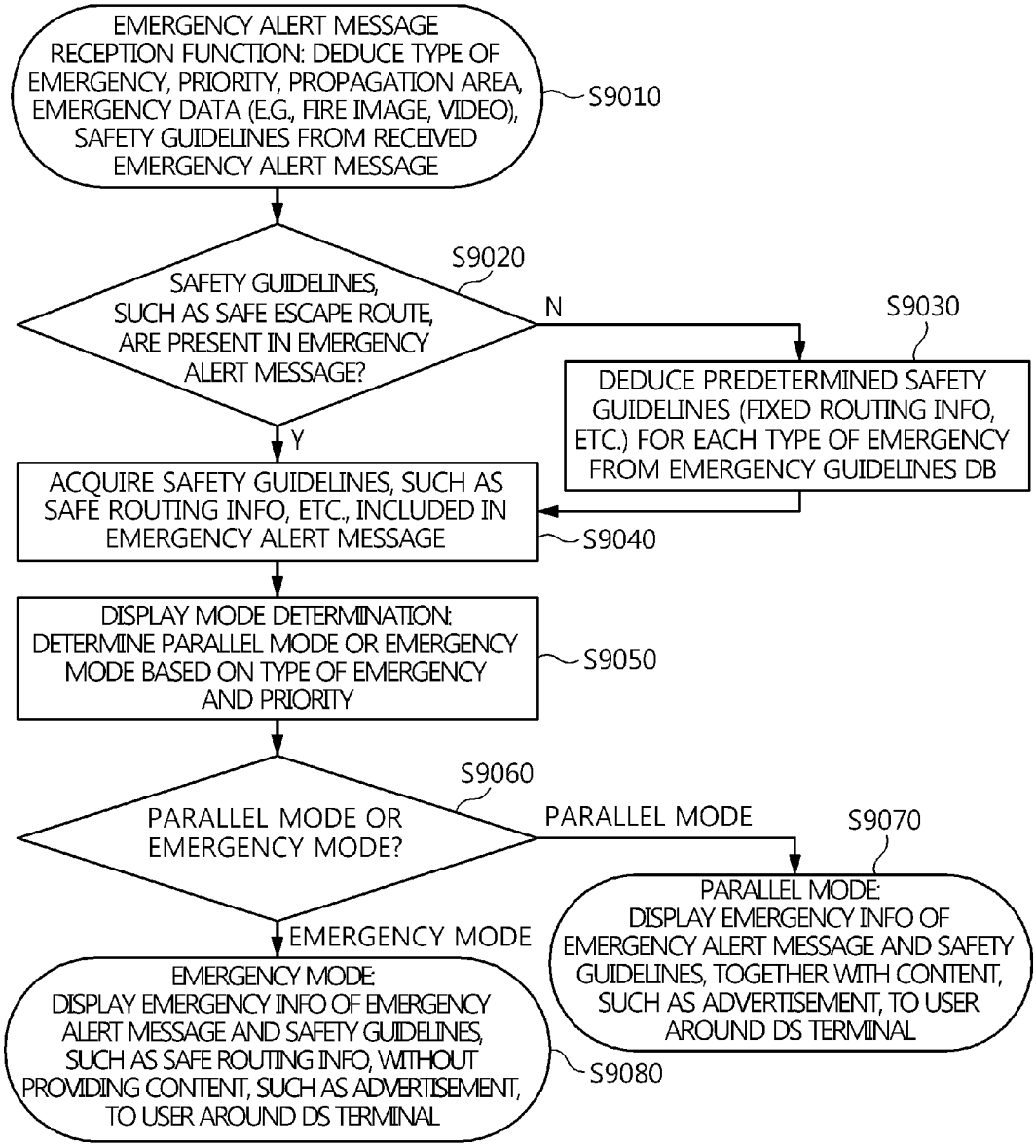
FIG. 9 is a flowchart illustrating a method by which a digital signage terminal receives and processes an emergency alert message according to an embodiment of the present invention.

FIG. 9 is a flowchart illustrating a method by which a digital signage terminal receives and processes an emergency alert message according to an embodiment of the present invention.

The digital signage terminal receives an emergency alert message at step S9010. The above-described information may be included in the received emergency alert message.

The digital signage terminal determines whether safety guidelines including a safe evacuation path is included in an emergency alert message at step S9020.

The digital signage terminal, if sufficient safety guidelines (for example, a preset evacuation path and the like) has not been set in the emergency alert message, extracts safety guidelines about an emergency situation using the information of a database at step S9030.

The digital signage terminal, if sufficient safety guidelines (for example, a preset evacuation path and the like) have been set in the emergency alert message, parses related information at step S9040.

The digital signage terminal determines whether to play back the emergency alert-related content alone or to play back the emergency alert-related content together with existing digital signage content using the display type information at steps S9050 and S9060.

If the display type information is indicative of parallel mode, the digital signage terminal displays the existing digital signage content and the emergency alert-related content together at step S9070.

If the display type information is indicative of emergency mode, the digital signage terminal terminates the existing digital signage content and the emergency alert-related content and displays emergency alert-related content at step S9080.

In this case, the emergency alert-related content refers to all information that can be derived from the above-described emergency alert message and content that can be generated from data. For example, the emergency alert-related content includes a screen operative to display the location of a shelter on a map, the text of an emergency alert, an evacuation direction indication, and the playback of screen commentary in voice.

At least one embodiment of the present invention has the advantage of enabling emergency information and the display of an emergency alert message using an existing digital signage terminal.

At least one embodiment of the present invention has the advantage of enabling the control of a digital signage terminal based on an emergency situation.

At least one embodiment of the present invention has the advantage of providing optimum information for the avoidance of an emergency situation to a user in the emergency situation.

At least one embodiment of the present invention has the advantage of providing information for the avoidance of an emergency situation to a visual or hearing impaired person in the emergency situation.

Although the preferred embodiments of the present invention have been disclosed for illustrative purposes, those skilled in the art will appreciate that various modifications, additions and substitutions are possible without departing from the scope and spirit of the invention as disclosed in the accompanying claims.

What is claimed is:

1. An emergency alert method using a digital signage system, comprising:

determining whether an emergency has occurred in a location by analyzing information collected from environment surrounding the location, the collected information including emergency-related information that is analyzed to identify a type of the emergency and information specifying a scope of the location affected by the emergency;

identifying at least one digital signage terminal to which the emergency-related information needs to be distributed upon occurrence of the emergency as determined by the determining and upon determining the at least one digital signage terminal is within an emergency area that is within the scope of the location affected by the emergency by referring to the collected emergency-related information and information of a database of a digital signage server;

converting the collected emergency-related information into an emergency alert message by a processor configured to generate the emergency alert message in a format supported by the identified at least one digital signage terminal, the emergency alert message identifying another digital signage terminal of surrounding the at least one digital signage terminal to which the emergency alert message is to be distributed, evacuation direction indication information specifying a direction to a shelter from the location of the identified at least one digital signage terminal, and evacuation direction indication supplementary information specifying turn direction in the direction indicated by the evacuation direction indication information; and transmitting the generated emergency alert message to the identified at least one digital signage terminal, wherein the transmitted generated emergency alert message is displayable together with existing digital signage content displayed by the at least one digital signage terminal, wherein the emergency alert message further comprises evacuation distance information indicative of a distance in the direction indicated by the evacuation direction indication information, wherein the evacuation distance information in the emergency alert message is used along with the evacuation direction indication information and/or the evacuation direction indication supplementary information.

2. The emergency alert method of claim 1, further comprising generating specific emergency-related evacuation path information using the emergency-related information;

wherein the generated emergency alert message further comprises the evacuation path information.

3. The emergency alert method of claim 1, further comprising:

converting the emergency-related information into voice information; and generating the emergency alert message including the voice information.

4. The emergency alert method of claim 1, further comprising:

converting the emergency-related information into sign language video information; and wherein the emergency alert message is generated to include the sign language video information.

5. The emergency alert method of claim 1, wherein:

the emergency-related information is received from one or more digital signage terminals or a national emergency alert center; and the emergency-related information comprises emergency alert-related data, audience measurement (AM) data, or surrounding ambient information of the one or more digital signage terminals.

6. The emergency alert method of claim 5, further comprising:

collecting one or more emergency-related information received from the one or more digital signage terminals; and analyzing an emergency situation using the collected emergency-related information, wherein the emergency alert message is generated using the analyzed emergency situation.

7. The emergency alert method of claim 1, wherein identifying the at least one digital signage terminal to which the emergency alert message needs to be distributed comprises:

extracting information about the type of emergency, urgency of the emergency, seriousness of the emergency, and the emergency area where emergency has an influence from the emergency-related information; and determining the at least one digital signage terminal to which the emergency alert message needs to be distributed based on the extracted information.

8. A digital signage terminal, comprising:

at least one processor to implement:

an emergency detection unit configured to collect information from environment surrounding a location, the collected information including emergency-related information of the digital signage terminal that is analyzed to identify a type of the emergency and information specifying a scope of the location affected by the emergency;

an emergency detection message generation unit configured to generate an emergency detection message by determining whether an emergency has occurred in a location by analyzing the collected emergency-related information, the emergency detection message being generated upon occurrence of the emergency as determined by the determining and upon determining the digital signage terminal is within an emergency area that is within a scope of the location affected by the emergency by referring to the received emergency-related information and information of a database of a digital signage server;

a communication unit configured to transmit the generated emergency detection message to a digital signage server, and to receive an emergency alert message including an emergency alert corresponding to an emergency situation from the digital signage server, the emergency alert message identifying the digital signage terminal, evacuation direction indication information specifying a direction to a shelter from the location of the digital signage terminal, and evacuation direction indication supplementary information specifying turn direction in the direction indicated by the evacuation direction indication information; and an emergency alert message processing unit configured to parse the emergency alert message, and to provide the emergency alert included in the emergency alert message to a user, wherein, the transmitted generated emergency alert message is displayable together with existing digital signage content displayed by the at least one digital signage terminal, wherein the emergency alert message further comprises evacuation distance information indicative of a distance in the direction indicated by the evacuation direction indication information, wherein the evacuation distance information in the emergency alert message is used along with the evacuation direction indication information and/or the evacuation direction indication supplementary information.

9. The digital signage terminal of claim 8, wherein:

the received emergency alert message further comprises specific emergency-related evacuation path information; and the emergency alert message processing unit performs control so that an evacuation path related to the emergency is displayed using the evacuation path information.

10. The digital signage terminal of claim 8, wherein the emergency alert message processing unit converts the information of the emergency alert message into voice information, and performs control so that the voice information is played back.

11. The digital signage terminal of claim 8, wherein the emergency alert message processing unit converts information of the emergency alert message into sign language video information, and performs control so that the sign language video information is played back.

12. The digital signage terminal of claim 8, wherein the emergency detection message comprises emergency alert-related data, AM data, or surrounding ambient information of the digital signage terminal.

13. The digital signage terminal of claim 8, wherein the emergency alert message processing unit performs control so that evacuation path information previously stored in the digital signage terminal is displayed in accordance with an emergency situation based on information included in the emergency alert message.

14. The digital signage terminal of claim 8, wherein the digital signage terminal checks remaining power of the digital signage terminal, and adjusts display brightness of the digital signage terminal to a lower value if the remaining power is lower than a threshold value.

* * * * *